US010626626B2

(12) United States Patent
Barraclough

(10) Patent No.: US 10,626,626 B2
(45) Date of Patent: Apr. 21, 2020

(54) LIFTING ANCHORS

(71) Applicant: ILLINOIS TOOL WORKS INC., Glenview, IL (US)

(72) Inventor: Andrew Saul Barraclough, Victoria (AU)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1109 days.

(21) Appl. No.: 14/396,806

(22) PCT Filed: Apr. 25, 2013

(86) PCT No.: PCT/US2013/038167
§ 371 (c)(1),
(2) Date: Oct. 24, 2014

(87) PCT Pub. No.: WO2013/163395
PCT Pub. Date: Oct. 31, 2013

(65) Prior Publication Data

US 2015/0101266 A1 Apr. 16, 2015

(30) Foreign Application Priority Data

Apr. 26, 2012 (AU) ..... 2012901631
Sep. 3, 2012 (AU) ..... 2012903823

(51) Int. Cl.
*E02D 35/00* (2006.01)
*E04G 21/14* (2006.01)
*B66C 1/66* (2006.01)

(52) U.S. Cl.
CPC ..... *E04G 21/147* (2013.01); *B66C 1/666* (2013.01); *E04G 21/142* (2013.01)

(58) Field of Classification Search
CPC ..... E04G 21/142; B66C 1/30; B66C 1/66; B66C 1/666; B28B 23/005
USPC ..... 52/125.2, 122.1, 124.2, 127.2, 125.6; 294/215, 82.1, 901, 92; D25/133, 134
See application file for complete search history.

(56) References Cited

U.S. PATENT DOCUMENTS 5,150,865 A * 9/1992 Miller ..... 248/71
7,934,343 B2 5/2011 Fletcher et al.
8,096,086 B2 * 1/2012 Fletcher ..... 52/125.4
8,413,400 B2 * 4/2013 Mackay Sim ..... 52/576
8,746,770 B2 6/2014 Sladojevic
8,966,834 B2 3/2015 Sladojevic
(Continued)

FOREIGN PATENT DOCUMENTS

AU 752353 B2 9/2002
AU 2006201337 A1 10/2006
(Continued)

OTHER PUBLICATIONS

ISR and WO for PCT/US2013/038167 dated Sep. 2, 2013.

*Primary Examiner* — Chi Q Nguyen
(74) *Attorney, Agent, or Firm* — Neal, Gerber & Eisenberg LLP

(57) ABSTRACT

A lifting anchor for embedment into a concrete component, the anchor having a head for releasable engagement with lifting equipment, and at least one leg extending from the head, the leg being profiled so as to lock into the surrounding concrete, wherein the profiling is formed by a series of formations arranged along at least a face and adjacent edge of the leg.

18 Claims, 6 Drawing Sheets

(56) References Cited

U.S. PATENT DOCUMENTS

| | | | | |
|---|---|---|---|---|
| 9,217,256 | B2 | 12/2015 | Sladojevic | |
| 2003/0213206 | A1 | 11/2003 | Hansort | |
| 2008/0196324 | A1* | 8/2008 | Mackay Sim | 52/125.4 |
| 2008/0203270 | A1* | 8/2008 | Connell et al. | 249/94 |
| 2009/0205268 | A1* | 8/2009 | Fletcher | 52/125.4 |
| 2010/0058677 | A1* | 3/2010 | Arteon | 52/122.1 |
| 2013/0091785 | A1* | 4/2013 | Sladojevic | 52/125.4 |

FOREIGN PATENT DOCUMENTS

| | | | |
|---|---|---|---|
| AU | 2008201712 | A1 | 11/2008 |
| EP | 1712705 | A2 | 10/2006 |
| FR | 1184868 | A | 7/1959 |
| WO | 9010763 | A1 | 9/1990 |
| WO | 2011006189 | A1 | 1/2011 |

* cited by examiner

LIFTING ANCHORS

RELATED APPLICATIONS

The present application is a National Phase of International Application Number PCT/US2013/038167 filed Apr. 25, 2013 which claims priority of Australian Application Number 2012901631 filed Apr. 26, 2012 and Australian Application Number 2012903823 filed Sep. 3, 2012.

FIELD OF THE INVENTION

The present invention relates to lifting anchors to be incorporated into concrete components during casting thereof to provide lifting points by which the component can be lifted and more particularly to edge lift anchors for incorporation into concrete panels.

BACKGROUND OF THE INVENTION

One type of edge lift anchor for use with concrete panels comprises a head configured for engagement with a lifting clutch and opposed generally parallel legs extending from the head to provide anchorage within the panel, the legs being appropriately profiled along their edges for that purpose. Various different designs of this type of anchor are in widespread use. Edge lift anchors of this type are currently formed by cutting from thick metal plate using non-contact high energy cutting means such as a laser beam or plasma arc with the edges of the legs being profiled in this cutting process.

The preferred embodiment to be described herein features a range of improvements in edge lift anchors of the general type discussed above and enabled by the use of alternative manufacturing methods.

SUMMARY OF THE INVENTION

According to the present invention there is provided a lifting anchor for embedment into a concrete component, the anchor having a head for releasable engagement with lifting equipment, and at least one leg extending from the head, the leg being profiled so as to lock into the surrounding concrete, wherein the profiling is formed by a series of formations arranged along at least a face and adjacent edge of the leg.

Further according to the invention, there is provided an edge lift anchor for embedment into a concrete panel, the anchor having a head for releasable attachment with lifting equipment, and a pair of generally parallel legs extending from the head, each leg being profiled so as to lock into the surrounding concrete, wherein the profiling is formed by a series of formations arranged longitudinally along each leg on an inner edge and opposed faces of the leg.

Still further according to the invention, there is provided a lifting anchor for embedment into a concrete component, the anchor having a head for releasable engagement with lifting equipment, and at least one leg extending from the head, the leg being profiled so as to lock into the surrounding concrete, wherein the profiling is formed by a series of formations arranged along at least a face of the leg.

Still further according to the invention there is provided a lifting anchor for embedment into a concrete component, the anchor having a head for releasable engagement with lifting equipment and at least one leg extending from the head, the leg being profiled so as to lock into the surrounding concrete, the anchor having reinforcing ribbing extend outer edge of substantially the entire length of the leg.

Still further according to the invention there is provided an edge lifting anchor for embedment into a concrete panel, the anchor having a head for releasable attachment with lifting equipment and a pair of generally parallel legs extending from the head, each leg being profiled so as to lock into the surrounding concrete, wherein each leg includes ribbing extending along its outer edge over substantially its entire length of the ribbing extending to adjacent the head of the anchor whereby the anchor is substantially configured in the manner of an eye-beam from adjacent the head to the remote ends of the legs.

BRIEF DESCRIPTION OF THE DRAWINGS

An embodiment of the invention will now be described by way of example only with reference to the accompanying drawings in which.

DETAILED DESCRIPTION OF THE DRAWINGS

The embodiments of the anchor now to be described herein incorporates a range of improvements over prior anchors of the type previously discussed particularly resulting from the use of alternative manufacturing techniques.

The edge lift anchor shown in the accompanying drawings is of the same general form as that described in Australian patent application 2006201337 of Cetram Pty Ltd (a subsidiary of the present applicants) and comprises a pair of opposed parallel legs 2 extending from a head 4. The particular head shown is designed for use with a releasable lifting clutch in the form of a ring clutch having an arcuate locking bolt received within an eye 6 in the head. The legs 2 are profiled with a series of saw-toothed formations 8 along their length. While the saw-toothed formations are similar to those described in detail in the aforesaid application and have a corresponding locking effect with the surrounding concrete when the anchor is under tensile load, there are differences as will be described subsequently.

In contrast to the anchor of the aforesaid application and which is cut from thick metal plate, the anchor of the preferred embodiment is fabricated by other techniques such as hot drop forging from a metal billet (the particularly preferred method), casting, or sintering. Not only does this lead to reduced manufacturing costs, it permits a range of significant design changes providing benefits such as increased anchor capacity and performance which in turn can enable a further manufacturing cost reduction for a given capacity of anchor and benefits in the installation of the anchor. In this respect it is to be noted that with edge lift anchors of the type in question cut from thick metal plate any design changes are predominantly confined to the configuration of the cut edges of the anchor while the opposed faces of the anchor which are formed out of the opposed faces of the plate are fundamentally planar. However by using other techniques as just indicated, shaping can be applied to all parts of the anchor including its opposed faces in order to provide desired technical/functional effects, as will now be described.

Figure 3:
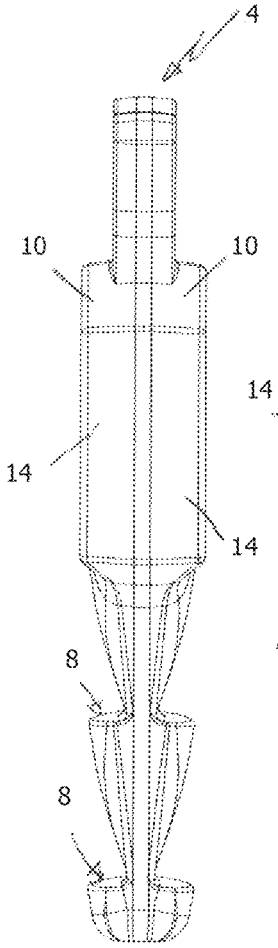
FIG. 3 is a view of the anchor from one edge (view from opposite edge corresponds)
Figure 2:
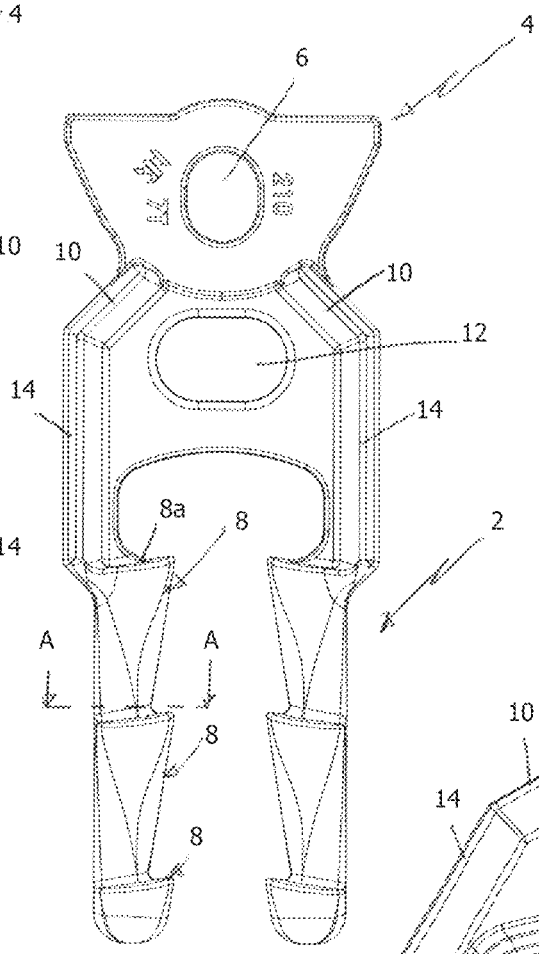
FIG. 2 is a view of the anchor from one face (view from opposite face corresponds)
Figure 1:
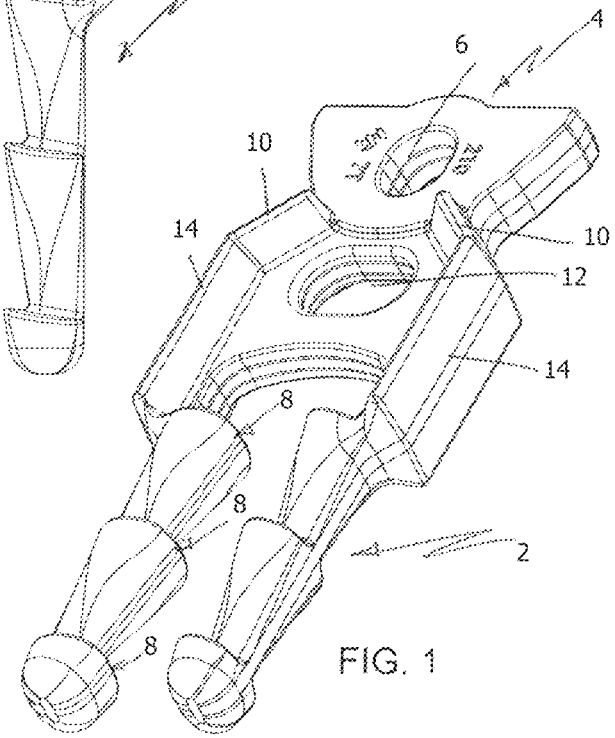
FIG. 1 is a perspective view of an edge lift anchor in accordance with an embodiment of the invention.
Figure 4:
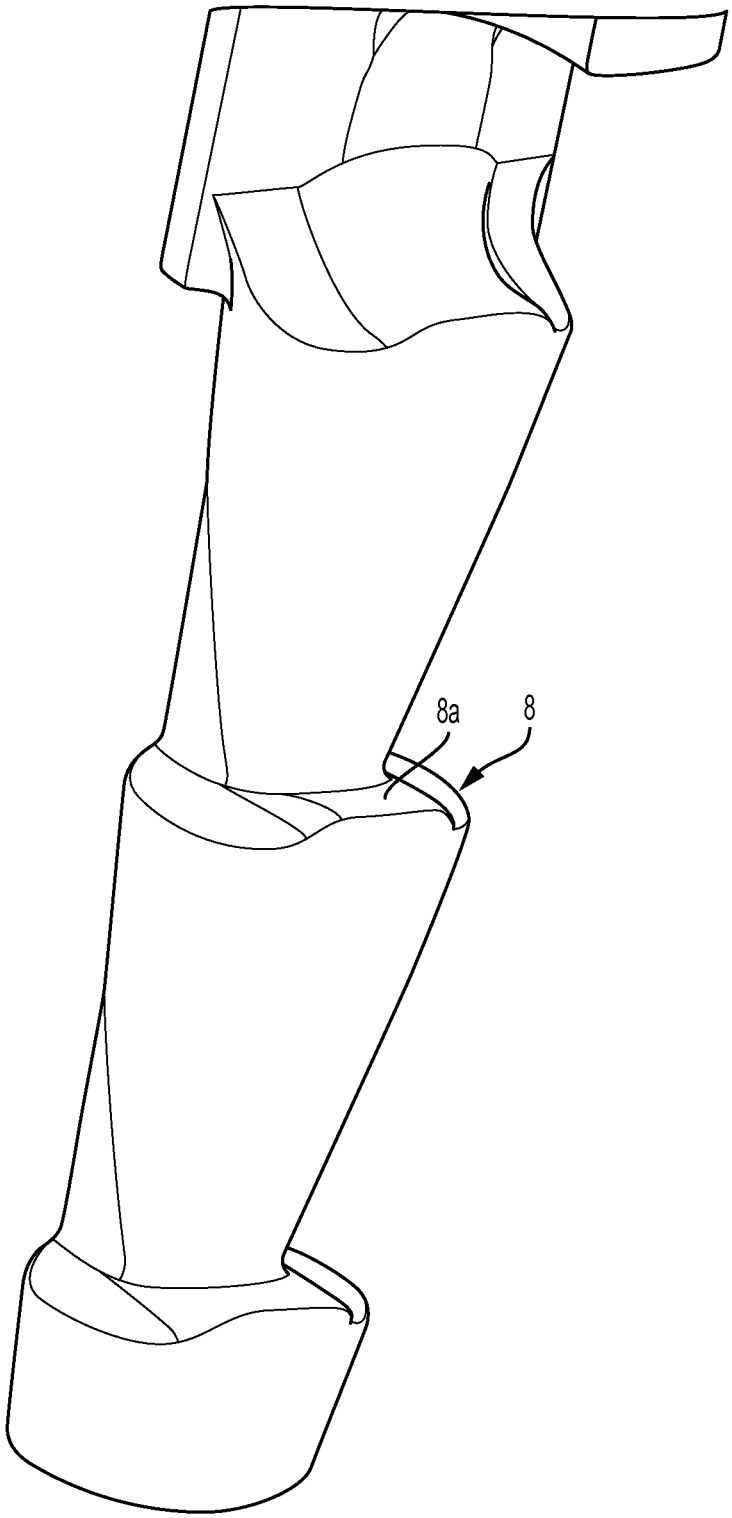
FIG. 4 is a fragmentary enlarged view showing in detail locking formations on each of the legs of the anchor.
Figure 5:
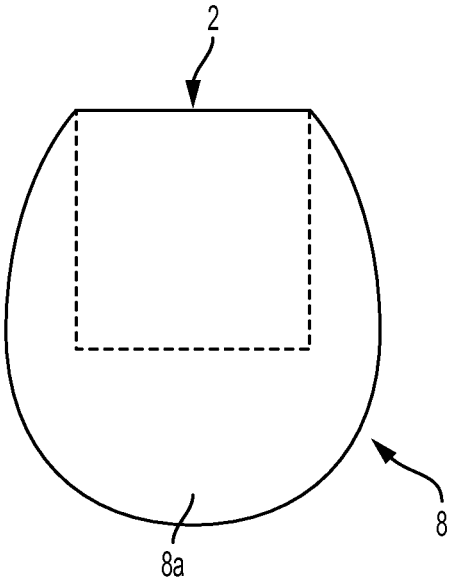
FIG. 5 is a section on line A-A of FIG. 2.
Figure 6:
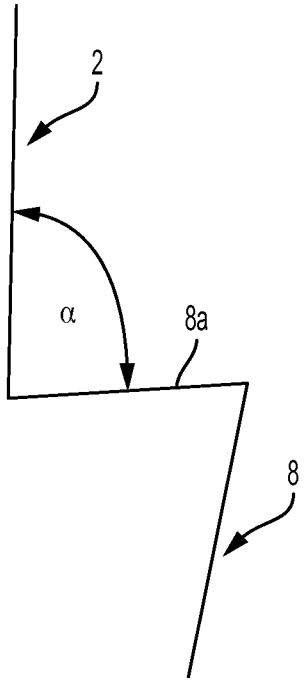
FIG. 6 is a schematic enlarged view to illustrate the inclination of the operative face of each anchoring formation on the respective legs of the anchor.

Although, as mentioned above, the legs of the preferred embodiment are formed with a series of generally saw-toothed formations along their length as generally described in the aforesaid application, in the preferred embodiment the formations 8 do not extend just along the inner edges of the legs as occurs with an anchor cut from thick metal plate, but they also extend onto the opposed faces of each leg as will be apparent from FIGS. 1 and 4. This increases the mechanical interlock with the surrounding concrete and increases the concrete capacity. In practice, the area of engagement between the upper inclined face 8*a* of each formation, and which is the operative face when the anchor is under tensile load, may be almost double that of a comparable anchor cut from metal plate. This in turn allows the length of the legs to be reduced for a given anchor capacity and hence enables a reduction in material costs. It is to be noted that whereas in the aforesaid application, the upper operative face of the formation is shown at a relatively "steep" angle of inclination and which is easily achievable by the cutting methods used, manufacture by hot drop forging is unlikely to achieve that. However it can achieve an upwards inclination of up to about 5° (corresponding to an acute angle $\alpha$ of 85° to the longitudinal axis of the leg) and that is still sufficient to provide the interlocking effects described in the aforesaid application.

It is to be noted that when hot drop forging is used to manufacture the anchor, due to the manner in which the forging tool closes onto the billet it is not possible for the entire upper operative face of the formation to achieve the desired upwards inclination and in practice this is achievable only in the portion adjacent the inner edge of the leg whereas the portions of the upper face adjacent the opposed faces of the leg will either be at right angles to the axis of the leg or feature a slight downwards inclination. This transformation in the inclination of the upper operative face can be seen in FIG. 4. Nevertheless the central portion of the upper operative face which is able to achieve the desired upwards inclination leads to the positive locking effects previously discussed whereas the outer portions of the face which do not, still have beneficial effect in increasing the area of engagement of the formation with the surrounding concrete and increases the concrete capacity. However, if other manufacturing techniques such as casting or sintering are used to manufacture the anchor it should be possible to achieve the desired upwards inclination over the entire surface of the formation.

It is to be noted that while it is preferred to use saw-toothed locking formations of the form discussed in detail above, other types of locking formations could alternatively be used and these may be on just one or more faces and/or edges of the leg according to the requirements of the particular anchor. The various manufacturing methods described permit significant versatility in the design of the anchor to provide a variety of different locking interactions between the leg and surrounding concrete.

In the upper part of the anchor immediately below the head 4 which is engaged by the ring clutch, the anchor is formed on each of its two opposed faces with inclined ribs 10 adjacent the respective edges of the anchor. In the embodiment shown, the ribs 10 are inclined at approximately 45° to the longitudinal axis of the anchor. These ribs act to increase the rigidity of the anchor in that zone and which is of particular utility when the anchor has in that zone an aperture 12 beneath the head for receiving a tension bar which is bent into a generally V-shaped configuration as is well known. This is of relevance in the initial phases of lifting the panel from the horizontal configuration in which it is cast to a generally vertical configuration. The ribs 10 also provide improved interlock with the surrounding concrete during these initial lifting phases. Longitudinal extensions 14 of the inclined ribs along each of the opposed edges of the anchor provide shear capacity during the initial phases of lifting from the horizontal to the generally vertical thereby obviating the need for the installer to incorporate shear bars for that purpose.

Figure 7:
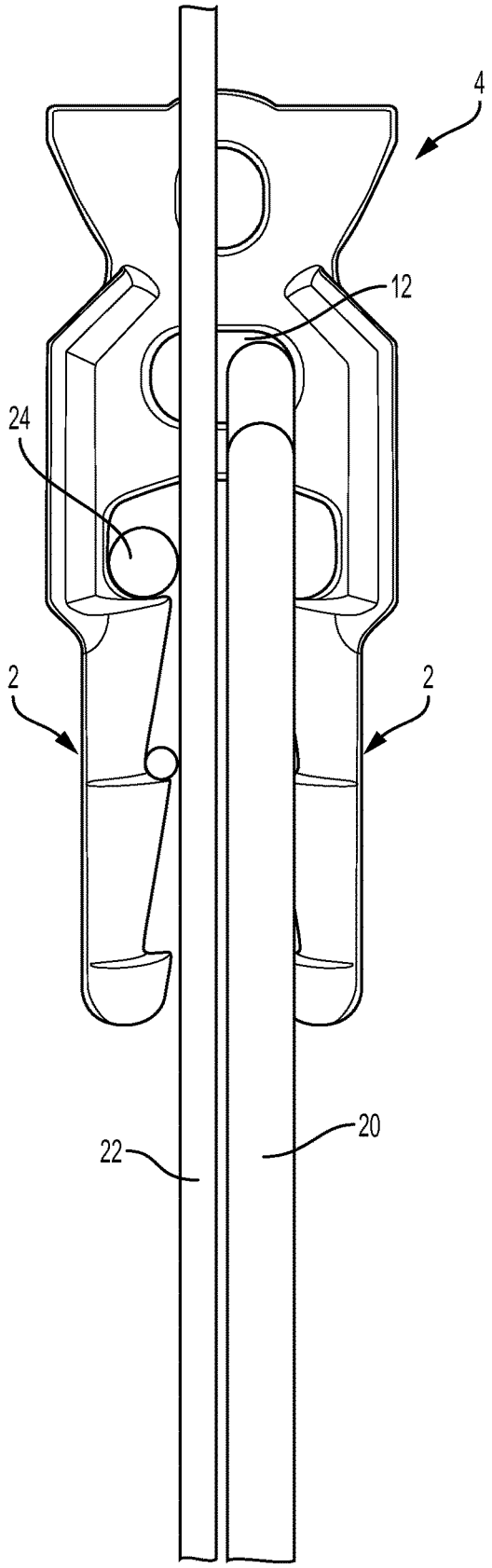
FIG. 7 illustrates the co-operation between the anchor, a tension bar, central mesh, and a perimeter bar prior to casting.

It will be noted that in the embodiment shown, the aperture 12 for the tension bar is of elongate form transversely of the longitudinal axis of the anchor, whereas in existing anchors of this type when such an aperture is present it is of circular form. This elongation enables the tension bar to be placed slightly "off centre" with respect to the panel while extending throughout its length substantially parallel to central reinforcing mesh within the panel and hence substantially parallel to the longitudinal axis of the anchor, it being understood that the length of the aperture is sufficient for that purpose. This is illustrated in FIG. 7 in which the tension bar is shown at 20, and the central mesh at 22. In contrast, with a centrally placed circular aperture for that purpose, the tension bar needs to be tilted in order to avoid the mesh and when the panel itself is relatively thin and the tension bar relatively long, the tilt can cause the remote ends of the bar to approach close to the surface of the panel. With the ability to place the tension bar "off centre" and also due to the presence of the longitudinal extensions 14 of the ribs which extend to the zone of the uppermost locking formations 8, the thickness of the legs 2 can be reduced in that area to provide an enlarged space into which a perimeter bar 24 could fit as shown in FIG. 7. The reduced leg thickness in that zone does not compromise the strength of the legs as a consequence of the presence of the reinforcement which is provided by the longitudinal rib extensions in that zone.

Figure 8:
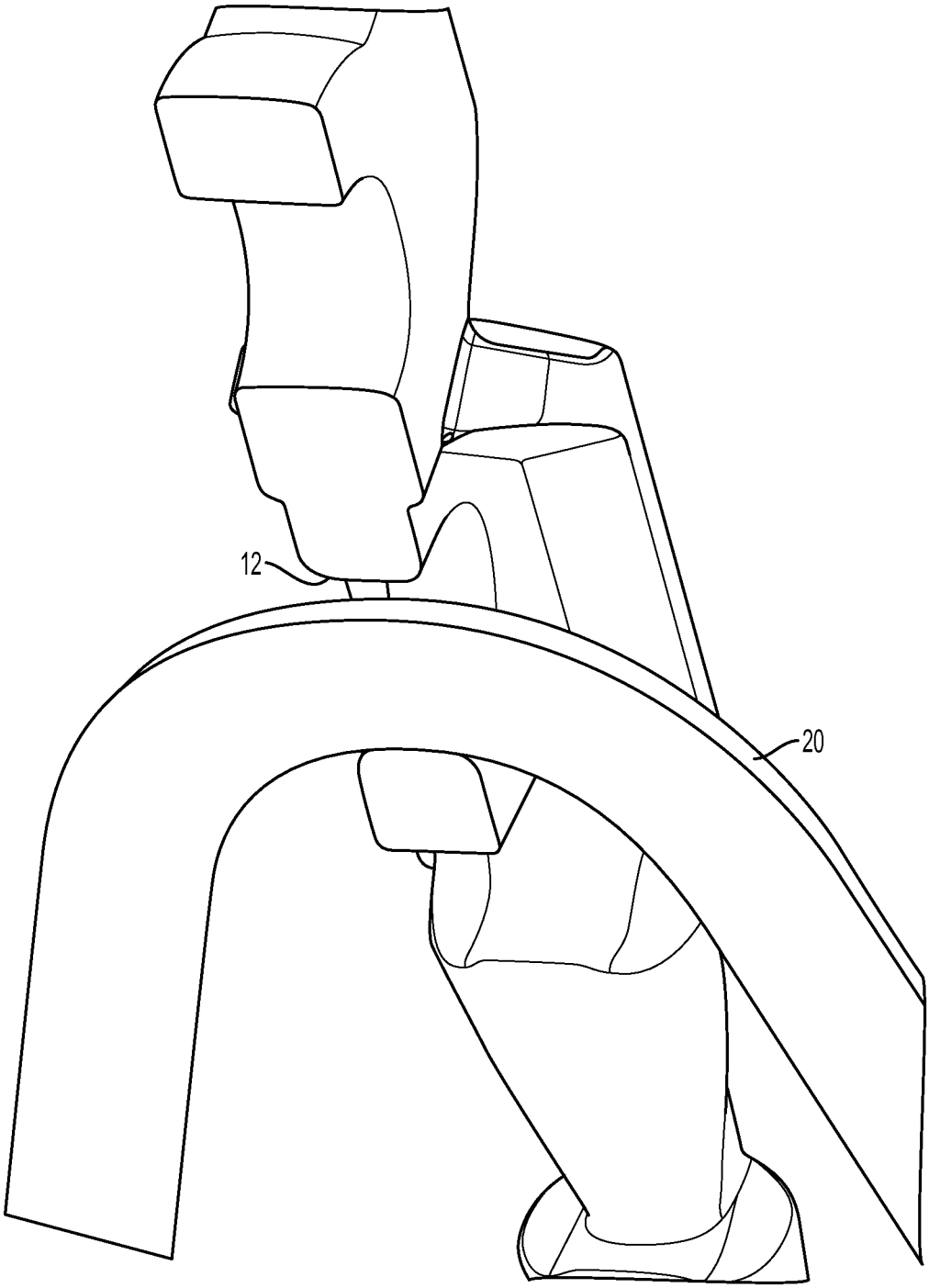
FIG. 8 is a fragmentary sectional enlarged view illustrating the co-operation between the tension bar and an arcuate upper edge of the tension bar aperture in the anchor head.

Advantageously, the lower surface of the tension bar aperture 12 is arcuate in transverse section with a curvature which matches the curvature of the bent apex of the tension bar as shown schematically in FIG. 8. Whereas in an anchor cut from metal plate the lower surface of the tension bar aperture is substantially linear in transverse section whereby the apex of the bent tension bar will just engage the edge portions of the aperture, by shaping the surface in the manner just described the apex of the tension bar engages the aperture over an increased area and reduces the shear component on the bar when under load. The consequence of this is the bar will yield at a higher loading and this enables a possible reduction in bar diameter for a given loading.

In existing anchors, the width of the head and which corresponds to the overall width of the anchoring portion defined by the two legs is such that when the lifting clutch is inclined at the start of lifting a panel from the horizontal configuration in which it is cast to a generally vertical configuration, the clutch body abuts against the upper edge of the head thereby blocking rotation of the clutch body beyond that point to prevent damage to the surrounding concrete of the panel. However, in existing anchors that engagement tends to occur very close to the end of the upper edge and that may result in some deformation of the head at that point when the anchor is under a loading close to its maximum loading. This deformation at the end of the edge can sometimes result in cracking of the surrounding concrete to which the edge of the head is immediately adjacent. In the preferred embodiment the width of the head is increased to provide an increased length of the upper edge whereby the clutch body when inclined will engage that edge at a position displaced more inwardly from the outer end of the edge. In particular the width is increased to permit engagement of the clutch body with the edge at a distance of approximately 12 to 16 mm from the end of the edge, depending on anchor and clutch capacity. In this regard, edge lift anchors are typically produced with lifting capacities of 3, 7, and 10 tonnes for use with lifting anchors of corresponding rating. Clutch bodies of typical lifting clutches within these ranges have a thickness of from around 48 to 55 mm and engagement of the clutch body with the anchor head at a point displaced inwardly from the end by a distance of the order indicated above can be achieved by producing a 3 tonne anchor with a head width of about 50 to 65 mm, 7 tonne capacity with a width of about 70 to 85 mm, and 10 tonne capacity with a width of about 75 to 90 mm. In one practical example, a 3 tonne anchor has a head width of 60+/−1 mm, a 7 tonne anchor has a head width of 80+/−1 mm, and a 10 tonne anchor has a head width of 85+/−1 mm. As the increased head width is for the purpose of achieving engagement with the clutch body by a greater distance displaced inwardly from the end it is not essential for the whole of the head to be of that width and in the preferred embodiment the head narrows inwardly from its widened upper edge in order to provide reduced material costs. That narrowing, although desirable for reasons just mentioned, is not essential from a functional perspective. With the increased head width, the diameter of the void formed in the edge of the concrete panel during casting and within which the head sits, is commensurately increased in diameter by using a void former of related size so that the edges of the head are immediately adjacent the concrete.

Figure 9:
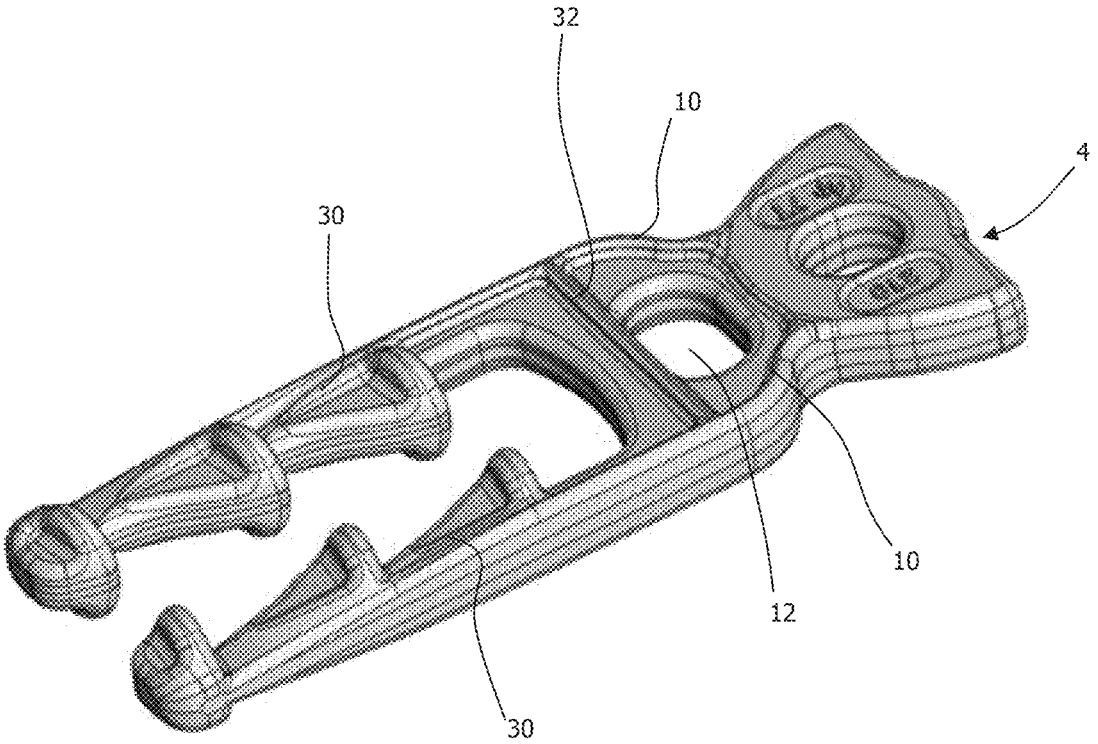
FIG. 9 is a perspective view of an edge lift anchor in accordance with another embodiment of the invention.

The anchor shown in FIG. 9 is very similar to that of FIGS. 1 to 8 and has features as those previously described but is of modified shape whereby the longitudinal rib extensions 14 of the previous embodiment now extend along the entire length of the legs of the anchor thereby forming ribs 30 as shown in FIG. 9; the opposite face of the anchor, not visible in FIG. 9, corresponds to that shown in FIG. 9. It will therefore be appreciated that in conjunction with the ribs 10 which are somewhat curved in this embodiment (in the previous embodiment they were substantially linear), the anchor is shaped approximately in the manner of an I-beam from immediately below the head 4. Based on I-beam theory this permits the anchor to be designed with greater strength in tension, shear, and in-plane shear while reducing the volume of material which would otherwise be required. Advantageously, a further transverse rib 32 is formed across the body of the anchor immediately below the tension bar aperture 12, again for strengthening purposes; a corresponding rib 32 is also provided beneath the aperture 12 at the opposite face of the anchor to that shown in FIG. 9.

It is to be understood that the I-beam construction of FIG. 9 would also be applicable to anchors which feature a locking formation different to that shown, and anchors without the elongate tension bar aperture or increased head width although these features are preferred features of the anchor of FIG. 9.

The embodiment has been described by way of example only and modifications are possible within the scope of the invention. For example although it is preferred for the anchor to have two parallel profiled legs extending from the head, it is in principle feasible for the anchor to have only a single such leg with the profiling on three sides of the leg or even on all four sides of the leg so as to interlock with the surrounding concrete. As an alternative to the production methods described herein, the anchor could be fabricated by machining from a single piece of metal or assembled from several separate components by welding together.

The manufacturing techniques discussed herein as an alternative to cutting from thick metal plate permit a variety of 3-D shaping options not achievable by the plate cutting technique previously used. As regards the leg or legs of the anchor although shaping with anchoring formations along opposed faces and the edge is preferred, depending on the technical requirements of the anchor it is possible to have the shaping just along the opposed faces or perhaps even along just one of the opposed faces.

It is to be understood that terms such as "upper" and "lower" and similar terms as used in the following claims and elsewhere in the specification are relative terms in relation to the configuration of the anchor when in a lifting state when the anchor and panel in which it is embedded are substantially vertical.

The claims defining the invention are as follows:

1. A lifting anchor for embedment into a concrete component, the anchor comprising:

a head configured to releasably engage with lifting equipment, the head including a front surface and a rear surface opposing the front surface, the head defining an eye extending through the front surface and the rear surface; and a first leg extending from the head, the first leg having a profile configured to lock into concrete of the concrete component that surrounds the first leg when the lifting anchor is embedded in the concrete component, wherein the profile includes a series of formations that forms a front surface of the first leg and an edge of the first leg adjacent to the front surface, and wherein the front surface of the head and the front surface of the first leg face the same direction.

2. The anchor of claim 1, wherein the series of formations is arranged on opposed surfaces of the first leg and on an edge of the first leg between the opposed surfaces, the opposed surfaces including the front surface of the first leg.

3. The anchor of claim 1, wherein each of the series of formations includes a leading edge facing upwardly towards the head and inclined at an acute angle to the axis of the first leg.

4. The anchor of claim 1, having reinforcing ribbing extending on each of two opposed side surfaces adjacent the head.

5. The anchor of claim 1, having ribbing extending along each of two opposed side surfaces adjacent the head to provide shear capacity in the initial stages of edge lifting a panel from a horizontal configuration in which the anchor is cast to a generally vertical configuration.

6. The anchor of claim 1, further comprising a zone adjacent to the head an aperture for receiving a tension bar, the aperture being elongate in a direction transverse to the longitudinal axis of the anchor.

7. The anchor of claim 1, wherein the eye is configured to receive a locking bolt of a lifting clutch in the form of a ring-clutch, the head having an upper edge engageable by the body of the ring clutch when the clutch body is inclined at the commencement of lifting a cast panel from the horizontal configuration in which the anchor is cast to a generally vertical configuration, wherein the width of the head is such that engagement between the clutch body and the edge of the head at the commencement of lifting from a horizontal configuration is at a sufficient distance from the edge of the head that any deformation of the edge of the head caused by engagement with the clutch body under the applied lifting load will be wholly contained within the width of the head.

8. The anchor of claim 1, wherein the anchor includes a length, a width and a thickness, the length being in the direction of extension of the legs, the width and thickness being in directions normal to each other and the direction of extension of the first leg, wherein the length is greater than the width and the width is greater than the thickness, and wherein the front surface of the first leg is normal to the direction of the thickness and parallel to the direction of the length and width.

9. The anchor of claim 8, wherein the edge of the first leg extends in a direction normal to the direction of the width and parallel to the direction of the length and thickness.

10. The anchor of claim 1, wherein the eye is configured to receive a locking bolt of a lifting clutch in a form of a ring clutch, the head having an upper edge engageable by the body of the ring clutch when the clutch body is inclined at commencement of lifting a cast panel from the horizontal configuration in the anchor is cast to a generally vertical configuration, wherein the width of the head is such that engagement between the clutch body and the edge of the head at the commencement of lifting from a horizontal configuration is at a sufficient distance from the end of the head that any deformation of the edge of the head caused by engagement with the clutch body under the applied lifting load will be wholly contained within the width of the head.

11. An edge lift anchor for embedment into a concrete panel, the anchor comprising:

a head configured to releasably attach with lifting equipment, the head including a front surface and a rear surface opposing the front surface, the head defining an eye extending through the front surface and the rear surface; and a pair of generally parallel legs extending from the head, each of the pair of legs having a profile configured to lock into concrete of the concrete panel that surrounds said leg when the lifting anchor is embedded in the concrete panel, wherein the profile includes a series of formations that forms an inner edge of said leg and opposed surfaces of said leg, and wherein the front surface of the head and one of the opposed surfaces of each of the pair of legs face the same direction.

12. The edge lift anchor of claim 11, wherein the anchor includes a length, a width and a thickness, the length being in the direction of extension of each of the pair of legs, the width and thickness being in directions normal to each other and the direction of extension of the pair of legs, wherein the length is greater than the width and the width is greater than the thickness and wherein each of the opposed surfaces of each of the pair of legs is normal to the direction of the thickness and parallel to the direction of the length and width.

13. A lifting anchor for embedment into a concrete component, the anchor comprising:

a head configured to releasable engage with lifting equipment, the head including a front surface and a rear surface opposing the front surface, the head defining an eye extending through the front surface and the rear surface; and a first leg extending from the head, the first leg having a profile configured to lock into concrete of the concrete component that surrounds the first leg when the lifting anchor is embedded in the concrete component, wherein the profile includes a series of formations that forms a front surface of the first leg, and wherein the surface of the head and the front surface of the first leg face the same direction.

14. The lifting anchor of claim 13, wherein the anchor includes a length, a width and a thickness, the length being in the direction of extension of the first leg, the width and thickness being in directions normal to each other and the direction of extension of the first leg, wherein the length is greater than the width and the width is greater than the thickness, and wherein the front surface of the first leg is normal to the direction of the thickness and parallel to the direction of the length and width.

15. A lifting anchor for embedment into a concrete component, the anchor comprising:

a head configured to releasably engage with lifting equipment;

a leg extending from the head, the leg including a profile configured to lock into concrete of the concrete component that surrounds the leg when the lifting anchor is embedded in the concrete component; and reinforcing ribbing extending the outer edge of substantially the entire length of the leg.

16. The lifting anchor of claim 15, wherein the anchor includes a length and width and a thickness, the length being in the direction of extension of the leg, the width and thickness being in directions normal to each other and the direction of extension of the leg, wherein the length is greater than the width and the width is greater than the thickness, and wherein the ribbing protrudes in the direction of the thickness.

17. An edge lifting anchor for embedment into a concrete panel, the anchor comprising:

a head configured to releasably attach with lifting equipment; and a pair of generally parallel legs extending from the head, each of the pair of legs including a profile configured to lock into concrete of the concrete panel that surrounds said leg when the lifting anchor is embedded in the concrete panel, wherein each of the pair of legs includes ribbing extending along an outer edge thereof over substantially the entire length thereof, the ribbing extending to adjacent the head of the anchor whereby the anchor is substantially configured in the manner of an I-beam from adjacent the head to the remote ends of the legs.

18. The edge lifting anchor of claim 17, wherein the anchor includes a length, a width and a thickness, the length being in the direction of extension of each of the pair of legs, the width and thickness being in directions normal to each other and the direction of extension of each of the pair of legs, wherein the length is greater than the width and the width is greater than the thickness, and wherein the ribbing protrudes in the direction of the thickness.

* * * * *